US005876184A

United States Patent [19]

Marcott

[11] Patent Number: 5,876,184

[45] Date of Patent: Mar. 2, 1999

[54] ELECTROHYDRAULIC PRESSURE REGULATING VALVE

[75] Inventor: Tony L. Marcott, Plainfield, Ill.

[73] Assignee: Caterpillar Inc., Peoria, Ill.

[21] Appl. No.: 621,924

[22] Filed: Mar. 26, 1996

[51] Int. Cl.[6] ..... F04B 49/22

[52] U.S. Cl. ..... 417/213

[58] Field of Search ..... 417/212, 213, 417/218; 137/625.65, 625.48, 528; 251/129.02, 121, 122; 60/347, 419, 452

[56] References Cited

U.S. PATENT DOCUMENTS 2,716,946 9/1955 Hardy ..... 417/213

4,441,686 4/1984 Seyffer ..... 137/528 X 4,699,571 10/1987 Bartholomaus ..... 417/213

5,127,435 7/1992 Takata et al. ..... 137/625.65

5,144,881 9/1992 Cakamaz ..... 137/626.65 X

*Primary Examiner*—Ismael Izaguirre

*Attorney, Agent, or Firm*—John W. Grant; J. W. Burrows

[57] ABSTRACT

An electrohydraulic pressure regulating valve comprises a variable orifice disposed between a supply port and a control port and has a fixed size vent orifice disposed downstream of the variable orifice and in parallel with the control port to reduce the flow forces acting on the spool so that the valve is less sensitive to solenoid and spool quality and has improved pressure control capability.

6 Claims, 1 Drawing Sheet

ELECTROHYDRAULIC PRESSURE REGULATING VALVE

TECHNICAL FIELD

This invention relates generally to an electrohydraulic pressure regulating valve and, more particularly, to one having a variable orifice upstream of a fixed size vent orifice.

BACKGROUND ART

Load sensing variable displacement pumps are sometimes utilized for continuously driving a rotary motor wherein the displacement of the pump is controllably regulated to change the speed of the motor. The electrohydraulic pressure regulating valves commonly used for controlling the displacement of the pump typically have a fixed size orifice disposed upstream of a variable orifice. The upstream variable orifice can be defined by either a spool or a poppet type metering element with the displacement thereof being controlled by a solenoid. One of the problems encountered with the pressure regulating valves having a spool is the repeatability of the area control of the valve opening due to the quality of the solenoid and/or spool and to high flow forces acting on the spool caused by high pressure drops across the spool. A severe stability problem was encountered with the poppet type pressure regulating valves in this environment.

In view of the above, it would be desirable to provide an electrohydraulic pressure regulating valve in which the flow forces acting on the valving element are low to reduce sensitivity to solenoid and spool quality, has good pressure control capability, and is easily scaled based on orifice ratios.

The present invention is directed to overcoming one or more of the problems as set forth above.

DISCLOSURE OF THE INVENTION

In one aspect of the present invention, an electrohydraulic pressure regulating valve comprises a variable orifice disposed between a supply port and a control port and a fixed size vent orifice disposed downstream of the variable orifice and in parallel with the control port.

BEST MODE FOR CARRYING OUT THE INVENTION

Figure 1:
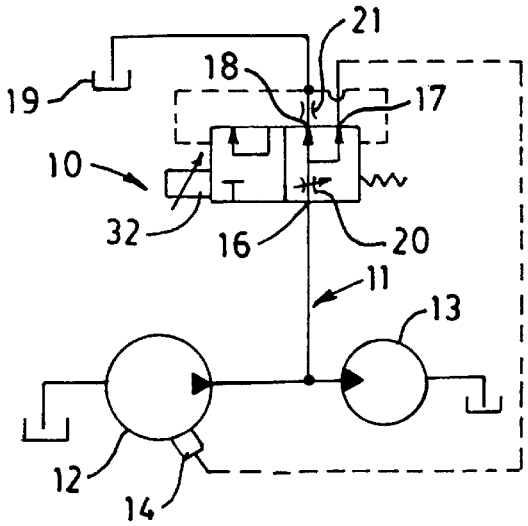
FIG. 1 is a schematic illustration of the present invention.
Figure 2:
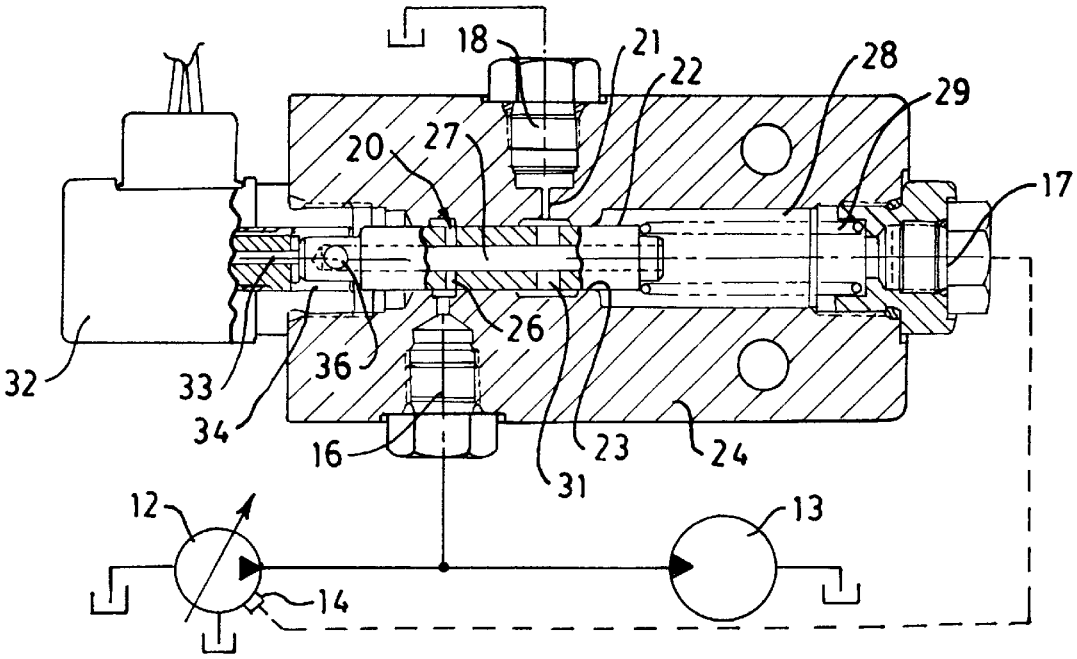
FIG. 2 is a cross-sectional diagrammatic view of the present invention.

With reference to the drawings, an electrohydraulic pressure regulating valve 10 is disclosed in combination with a hydraulic system 11 having a load sensing variable displacement pump 12 connected to a rotary hydraulic motor 13. The pump includes a displacement controller 14 for regulating the pump output pressure in response to a control signal output from the pressure regulating valve.

The pressure regulating valve 10 includes a supply port 16 connected to the pump 12, a control port 17 connected to the displacement controller 14 of the pump 12, and a tank port 18 connected to a tank 19. A variable orifice 20 is disposed between the supply port 16 and the control port 17. A fixed size vent orifice 21 is disposed downstream of and in series with the variable orifice and in parallel with the control port.

The pressure regulating valve 10 includes a valve spool 22 slidably disposed within a bore 23 of a body 24. The variable orifice 20 is defined by the spool and includes a pair of radial passages 26 in continuous communication with a longitudinal passage 27 in the spool. The passage 27 opens into a spring chamber 28 containing a spring 29 which biases the spool to the position shown establishing the maximum flow area of the variable orifice. The control port 17 continuously communicates with the spring chamber.

The vent orifice 21, in this embodiment, is defined by the body and is in continuous communication with the passage 27 through a plurality of radial passages 31 having a combined flow area greater than the maximum flow area of the variable orifice. Alternatively, the flow area of the radial passages 31 can be downsized to provide the vent orifice with the radial passages then communicating directly with the tank port 18.

An electromagnetic force motor in the form of a solenoid 32 is connected to the valve body 24 and has an armature 33 disposed for engagement with the valve spool 22. The passage 27 continuously communicates with a chamber 34 through a plurality of radial passages 36 to equalize forces acting on the spool generated by the control pressure.

Industrial Applicability

In use, the pressure regulating valve 10 is operative to control the rotational speed of the hydraulic motor 13 by controlling the output pressure of the pump 12. Specifically, with the solenoid 32 de-energized, the spring 29 urges the spool 22 to the position shown so that a series flow relationship is established through the variable orifice 20 and the fixed vent orifice 21 between the supply port 16 and the tank port 18. The pressure level of the control signal exiting the control port 17 is essentially established by the orifice area ratios and is at its maximum pressure level when the spool is in the position shown. The output volume of the pump 13 is at its maximum when receiving the high pressure control signal and thus the motor 13 is rotated at a speed dictated by the output flow from the pump 13.

To decrease the output speed of the motor 13, an electrical signal is directed to the solenoid 32 so that the armature 33 moves the spool 22 rightward to decrease the flow area of the variable orifice 26. This reduces the pressure level of the control signal to the displacement controller thereby decreasing the output from the pump.

In view of the above, it is readily apparent that the structure of the present invention provides an improved electrohydraulic pressure regulating valve that reduces the flow forces acting on the spool so that the valve is less sensitive to solenoid and spool quality and has improved pressure control capability. This is accomplished by positioning a variable orifice between a supply port a fixed size vent orifice disposed downstream of the variable orifice in parallel with the control port.

Other aspects, objects and advantages of this invention can be obtained from a study of the drawings, the disclosure and the appended claims.

I claim:

1. An electrohydraulic pressure regulating valve comprising;

a supply port;

a control port;

a variable orifice disposed between the supply port and the control port; and a fixed size vent orifice disposed downstream of and in series with the variable orifice and in parallel with the control port.

2. The pressure regulating valve of claim 1 including a valve spool defining the variable orifice.

3. The pressure regulating valve of claim 2 including a spring resiliently biasing the valve spool toward its open position and a solenoid disposed to exert a force on the valve spool in a direction for closing the variable orifice.

4. The pressure regulating valve of claim 3 including a body slidably receiving the valve spool the vent orifice being defined by the valve body.

5. The pressure regulating valve of claim 4 wherein the flow area of the vent orifice is less than the flow area of the variable orifice when the variable orifice is fully opened.

6. The pressure regulating valve of claim 1 in combination with a hydraulic system including a load sensing pump connected to the supply port and having a displacement controller connected to the control port.

* * * * *